US005312163A

United States Patent [19]

Hanamoto et al.

[11] Patent Number: 5,312,163

[45] Date of Patent: May 17, 1994

[54] SYSTEM FOR AIDING OPERATION OF EXCAVATING TYPE UNDERGROUND ADVANCING MACHINE

[75] Inventors: Tadayuki Hanamoto; Norio Takahashi, both of Kanagawa, Japan

[73] Assignee: Kabushiki Kaisha Komatsu Seisakusho, Japan

[21] Appl. No.: 965,271

[22] PCT Filed: Jul. 12, 1991

[86] PCT No.: PCT/JP91/00940

§ 371 Date: Jan. 13, 1993

§ 102(e) Date: Jan. 13, 1993

[87] PCT Pub. No.: WO92/01140

PCT Pub. Date: Jan. 23, 1992

[30] Foreign Application Priority Data

Jul. 13, 1990 [JP] Japan ..... 2-184098

[51] Int. Cl.[5] ..... E21D 9/10; E21D 9/06

[52] U.S. Cl. ..... 299/1.8; 299/1.05; 299/31; 405/138; 405/143

[58] Field of Search ..... 405/143, 142, 141, 138, 405/146; 299/31, 33, 1.05, 1.8, 1.5, 56, 18

[56] References Cited

U.S. PATENT DOCUMENTS

| | | | |
|---|---|---|---|
| 4,023,861 | 5/1977 | Schnell | 299/1.8 |
| 4,027,210 | 5/1977 | Weber | 299/1.8 X |
| 4,311,411 | 1/1982 | Akesaka et al. | 405/143 X |
| 4,984,289 | 1/1991 | Atakawa et al. | 299/1.8 X |
| 5,017,045 | 5/1991 | Kiritani et al. | 405/143 |
| 5,186,579 | 2/1993 | Hanamoto et al. | 405/143 |

FOREIGN PATENT DOCUMENTS

| | | |
|---|---|---|
| 59-135298 | 8/1983 | Japan . |
| 62-268494 | 11/1987 | Japan . |
| 62-282220 | 12/1987 | Japan . |
| 1-94195 | 4/1989 | Japan . |
| 1-263385 | 10/1989 | Japan . |
| 2-115492 | 4/1990 | Japan . |

*Primary Examiner*—Dennis L. Taylor
*Attorney, Agent, or Firm*—Ronald P. Kananen

[57] ABSTRACT

A system for supporting the drive of an excavating type underground advancing machine is provided to lighten the operator's burden so that an unskilled operator can perform operation comparable to that of the skilled operator. In this system for supporting the drive, output signals from a group of first sensors (12*a*) for measuring magnitude of operation of a rocking actuator (10) for orientation control and an output signal from a second sensor (12*b*) for measuring cutter torque pressure are input into an automatic measurement portion (14). These signals are adjusted in an automatic adjustment portion (15) and input to a fuzzy control portion. The rocking magnitude of an excavating cutter is calculated in a rocking magnitude control aiding system portion (16*a*) in response to the adjusted signal from the group of the first sensors. An optimal cutter torque control operating information is calculated in a cutter torque control aiding system portion (16*b*) in response to an adjusted signal from the second sensor, and the both results of calculation are displayed on a display output device (17).

8 Claims, 14 Drawing Sheets

(INCREASING OF GAUGE)

SYSTEM FOR AIDING OPERATION OF EXCAVATING TYPE UNDERGROUND ADVANCING MACHINE

FIELD OF THE INVENTION

The present invention relates to a system for aiding operation of an excavating type underground advancing machine which advances in the earth with excavation by means of a cutter drum.

BACKGROUND OF THE INVENTION

Conventionally, an orientation control and a torque control of a cutter drum in a small diameter pipe shielding machine or an excavating type underground advancing machine have been performed relying on perception and experience of operators.

FIG. 26 shows the conventional method of control for the advancing machine, in which steps of detecting errors in vertical and horizontal directions, pitching angle, yawing angle of an excavation head by means of a sensor group, and of determination of a rocking magnitude according to a judgement of the operator based on the detected data are performed during an interval between "rear propelling jack contraction" and "rear propelling pin insertion". The rocking magnitude of a cutter drum is controlled on the basis of the determined value.

On the other hand, at this time, a hydraulic pressure of an actuator for rotatingly driving the cutter drum is constantly monitored for performing control operation of the cutter torque while the rear propelling jack is advanced.

In the above-mentioned conventional control method, a problem is encountered in significant variation of a precision in construction of a tunnel depending upon the skill of the operator for reliance to the operators' perception and experience, as set forth above.

SUMMARY OF THE INVENTION

In view of the problem set forth above, it is an object of the present invention to provide a drive supporting system for an excavating type underground advancing machine which permits contructional operation equivalent to a qualified operator even by an unqualified operator and can reduce work load of the operator.

In order to accomplish the above-mentioned object, a system for aiding operation of an excavating type underground advancing machine, according to a primary aspect of the present invention, comprising:

a rocking actuator for controlling orientation;

an excavation cutter provided at the front face of a cutter drum positioned at the tip end;

a first sensor group for monitoring a position error magnitude and angular deflection magnitude relative to a construction planning line, and an operation magnitude of said rocking actuator;

a second sensor for monitoring a fluid pressure for a cutter torque;

wherein the system further comprising:

an automatic measurement portion for obtaining output signals of said sensors group and said cutter torque pressure sensor;

an automatic adjustment portion for adjusting said signals as input values for fuzzy inference;

a rocking magnitude control aiding portion for outputting an optimal rocking magnitude of said orientation controlling actuator for the next advancing pitch based on the adjusted input values of said first sensor group through fuzzy inference;

a cutter torque control aiding portion for outputting a control information for the excavating cutter toque based on the adjusted input value from said second sensor for cutter torque pressure control through the fuzzy inference; and a display output device for displaying the outputs of said both system portions.

With the foregoing aspect of the drive supporting system, in a sequence of advancing operation of the excavation type advancing machine, the rocking magnitude of the excavation cutter for the next advancing pitch is derived by the rocking magnitude control aiding system portion and the result is displayed on the display output portion when the rocking magnitude for the next advancing pitch of the excavation cutter is to be determined with taking the preceding constructing condition. Also, while excavation is performed by rotating the excavation cutter, the optimal cutter torque control operation information is derived by the cutter torque control aiding system portion and the result is displayed on the display output device. The operator may perform operation with watching the display.

Therefore, according to the present invention, in the construction employing the excavating type advancing machine, it allows even for unskilled operator to perform operation comparable to the skilled operator. Also, since the aiding items can be displayed to the operator upon necessity on the display output device, the work load on the operator can be reduced.

The above-mentioned and other objects, aspects and advantages of the present invention will become clear to those skilled in the art from the discussion described and illustrated in connection with the accompanying drawings which illustrate preferred embodiments meeting with the principle of the invention.

DESCRIPTION OF THE PREFERRED EMBODIMENT

One embodiment of the present invention will be discussed herebelow with reference to FIGS. 1 through 25.

Figure 3:
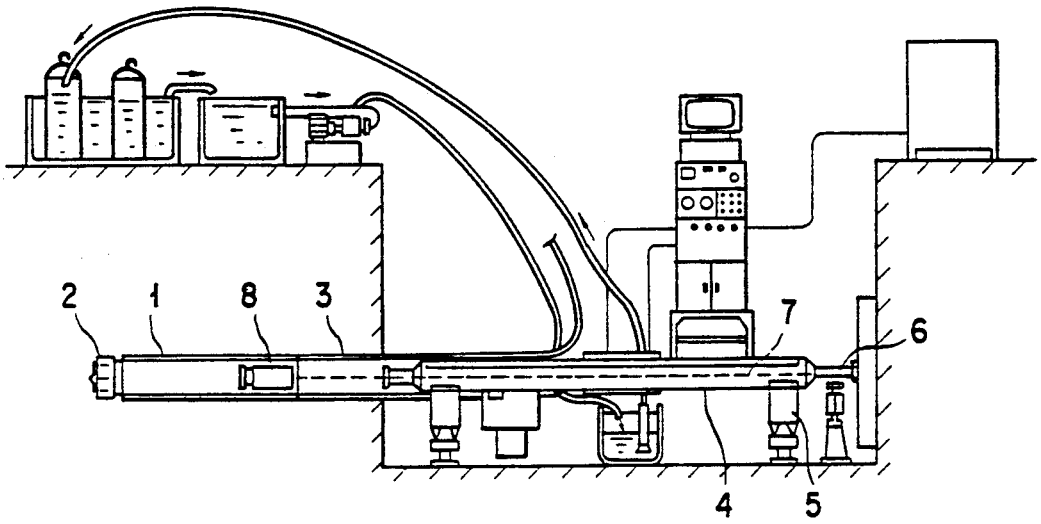
FIG. 3 is a schematic illustration showing construction of an excavating type underground advancing machine in advancing condition.

FIG. 3 shows an excavating type underground advancing machine in advancing condition. In the drawings, the reference numeral 1 denotes an excavation pilot head carrying a cutter head 2 at the tip end thereof. The reference numeral 3 denotes a pilot pipe connected to the rear portion of the excavation pilot head 1, and the reference numeral 4 denotes a pilot pipe propelling adapter connected to the pilot pipe 2 and supported on a rear portion propelling base 5. On the other hand, the reference numeral 6 denotes a laser transit, from which a laser beam 7 is irradiated to a laser target 8 for detecting the attitude of the excavation pilot head 1.

Figure 4:
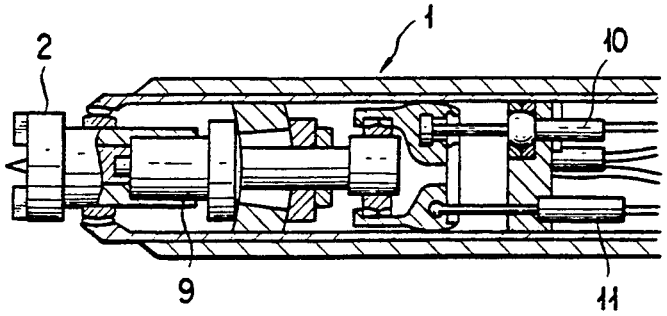
FIG. 4 is a fragmentary section of an excavation pilot head.

FIG. 4 illustrates a general construction of the above-mentioned excavation pilot head 1. The cutter drum 2 is adapted to be rotatingly driven by a hydraulic motor 9. On the other hand, the cutter drum 2 is rockably supported. A rocking actuator 10 is provided for rocking motion of the cutter drum 2. The reference numeral 11 denotes a rocking magnitude sensor for detecting magnitude of the rocking motion.

The advancing machine constructed as set forth above is advanced by rotatingly driving the cutter drum 2 by means of the hydraulic motor 9 while the cutter drum 2 is depressed forward by the rear portion propelling base 5. At this time, control of the advancing direction is performed by actuating the rocking actuator 10 for rocking motion of the cutter drum 2.

Figure 5:
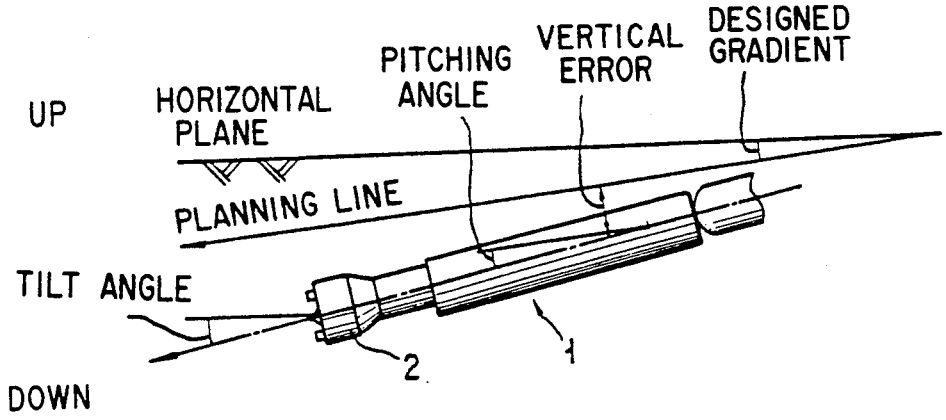
FIGS. 5 and 6 are explanatory illustration showing attitude of the excavation pilot head.
Figure 6:
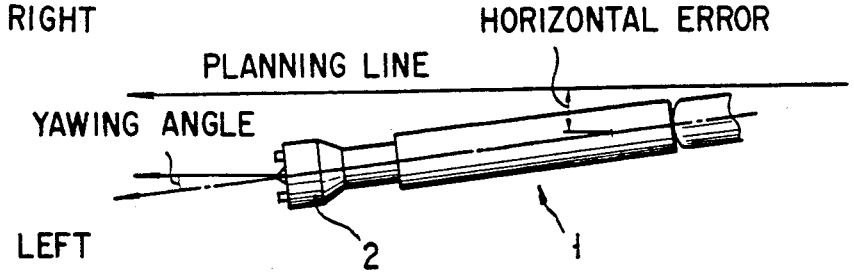

On the other hand, the attitude of the excavation pilot head 1 relative to a planed advancing line, i.e. errors in the vertical and horizontal directions, a pitching angle and a yawing angle as shown in FIGS. 5 and 6, are detected by respective sensors provided on the laser transit 6 and the laser target 8. Also, the rocking magnitude of the rocking actuator 10 is detected by a rocking magnitude sensor 11.

Figure 1:
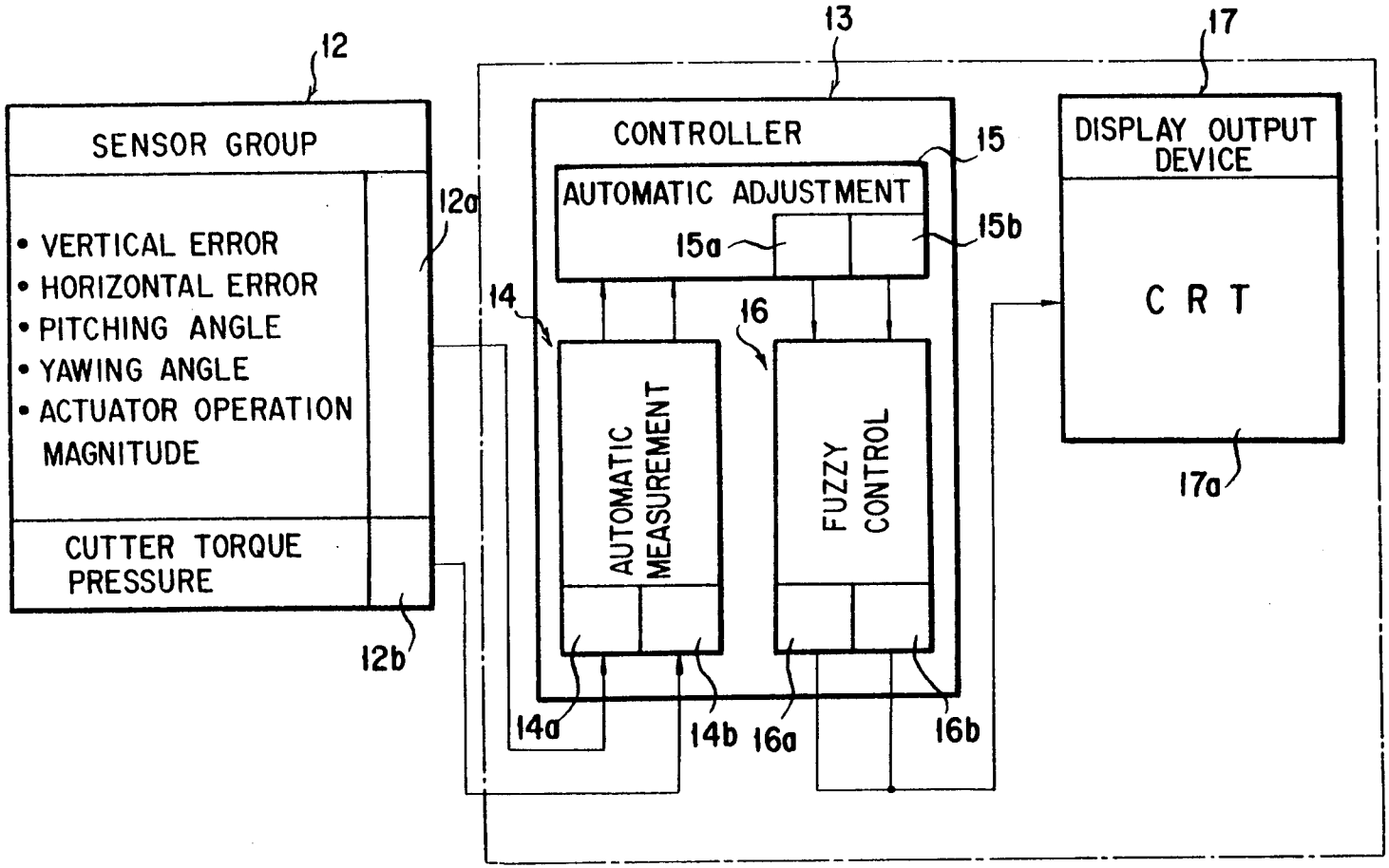
FIG. 1 is a block diagram showing one embodiment of the present invention.

FIG. 1 is a block diagram of the above-mentioned excavation type underground advancing machine (hereafter referred to as "advancing machine".

FIG. 12 shows a sensor group provided in the excavation pilot head 1. The group of the sensors includes an orientation control sensor group 12a for monitoring a vertical error, a horizontal error, the pitching angle, yawing angle and the operation magnitude of the rocking actuator 10 and so forth, and a cutter torque pressure sensor 12b for monitoring a hydraulic pressure of the cutter drum 2, which pressure is a discharge pressure of the hydraulic motor 9 for driving the cutter drum 2.

The reference numeral 13 denotes a controller which comprises an automatic measurement portion 14, an automatic adjustment portion 15 and a fuzzy control portion 16. The automatic measurement portion 14 has a first measurement section 14a for receiving detection signals from the orientation control sensor group 12a and a second measurement section 12b for receiving the detection signal from the cutter torque pressure sensor 12b. On the other hand, the automatic adjustment portion 15 includes a first adjustment section 15a for converting two input values by adjusting data of the errors, the pitching angle or the yawing angle, the operation magnitude of the rocking actuator and variation magnitude of the pitching angle or the yawing angle after advancing for one pitch, and a second adjustment portion for detecting an instantaneous hydraulic pressure and variation magnitude thereof at every predetermined time interval $t_1$ and adjusting them as two input values. The fuzzy control portion 16 includes a two input and one output type rocking magnitude control aiding system section 16a performing fuzzy inference in response to input of the two input values adjusted by the first adjustment section 15a of the automatic adjustment portion 15 and outputting an optimal rocking operational magnitude for the next advancing pitch to a CRT 17a of a display output device 17, and a two input and one output type cutter torque control aiding system section 16b similarly performing fuzzy inference in response to inputs from the second adjustment section 15b and outputting an optimal cutter torque control operation information through a certain period $t_2$ as a display output to the CRT 17a of the display output device 17.

Next, discussion will be given for the operation of the rocking magnitude control aiding system (advancing direction control) for the cutter drum.

By means of orientation control sensor group 12a in the sensor group 12, the pitching angle and the vertical error in the vertical direction illustrated in FIG. 5 are measured. Similarly, the yawing angle and the horizontal error in the horizontal direction illustrated in FIG. 6 are measured.

Figure 2:
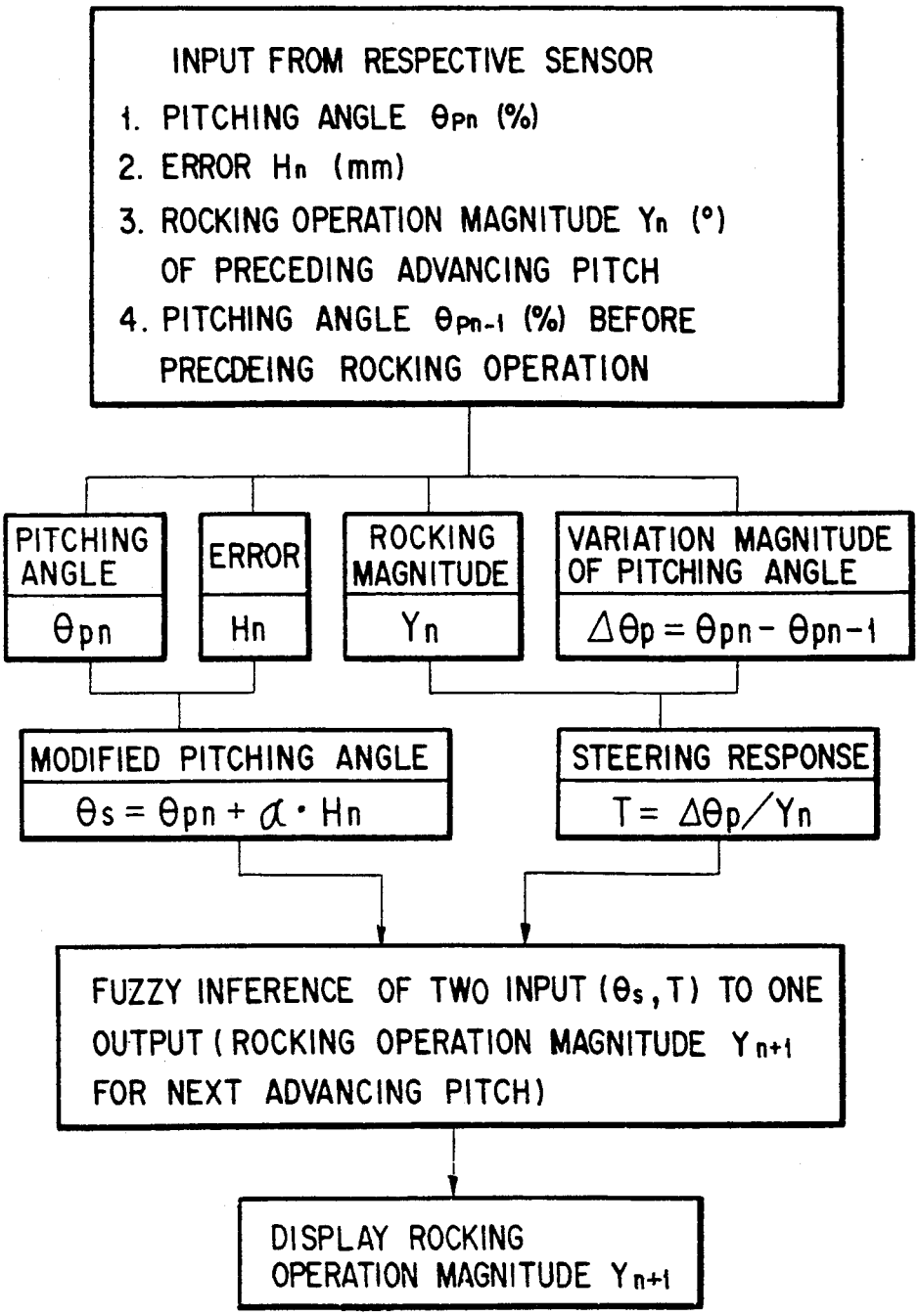
FIG. 2 is a flowchart showing operation of a rocking magnitude control aiding system portion.

FIG. 2 is a flowchart illustrating the operation of the rocking magnitude control aiding system section 16a of the fuzzy control portion 16. Discussion will be given for the operation of the rocking magnitude control aiding system section 16a based on FIG. 2 and the block diagram in FIG. 1.

The pitching angle $\theta_{pn}$ (%), the error $H_n$ (mm), the rocking operation magnitude in the preceding advancing pitch $Y_n$ (degree), and the pitching angle $\theta_{p-n}$ (%) before preceding rocking operation are detected by the orientation control sensors 12a of the sensor group 12. These are input to the first measurement section 14a of the automatic measurement portion 14.

Then, the measured values are input to the first adjustment section 15a of the automatic adjustment portion 15. In the first adjustment section 15b, a modified pitching angle $\theta_s=\theta_{pn}+\alpha\cdot H_n$ is derived based on the pitching angle $\theta_{pn}$ and the error $H_n$, and a steering response $T=\Delta\theta_p/Y_n$ based on the rocking operation magnitude $Y_n$ and the variation magnitude $\Delta\theta_p=\theta_{pn}-\theta_{pn-1}$. These two values become the input values. $\alpha$ is a constant.

These two input values $\theta_s$ and T are input to the rocking magnitude control aiding system section 16a of the fuzzy control portion 16. Here, through fuzzy inference, one output value representative of the operation magnitude $Y_{n+1}$ of the rocking actuator 10 for the next advancing pitch is derived with incorporating the manner of operation of the skilled operators.

Then, thus derived operation magnitude $Y_{n+1}$ is displayed on the CRT 17a of the display output device 17.

In general, in order to advance the advancing machine along the planed line, it becomes necessary to orient the advancing machine to have a gradient parallel to the planed line. However, in conjunction therewith, since the error has to be reduced, the gradient has to be deflected from the angle parallel to the planed line for the corresponding magnitude. This is represented by the above-mentioned modified pitching angle $\theta_s$.

On the other hand, effectiveness of the control of advancing direction (herein after simply referred to as "steering"), namely steering response is variable depending upon the soil type. This can be judged from restriction of variation magnitude of the gradient in response to the rocking operation. This is represented by the steering response $T=\Delta\theta_p/Y_n$.

Through the process set forth above, the rocking operation magnitude $Y_{n+1}$ for the next advancing pitch is determined on the basis of the modified pitching angle $\theta_s$ and the steering response T employing the fuzzy inference.

Figure 7:
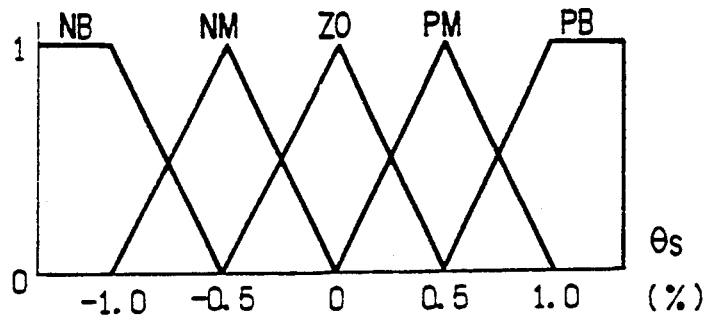
FIGS. 7, 8 and 9 are charts showing membership functions.
Figure 8:
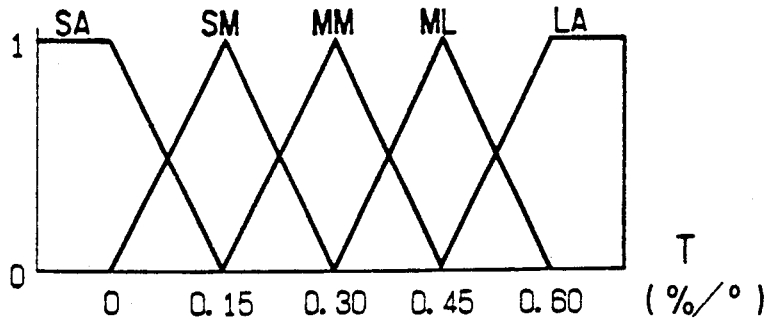
Figure 9:
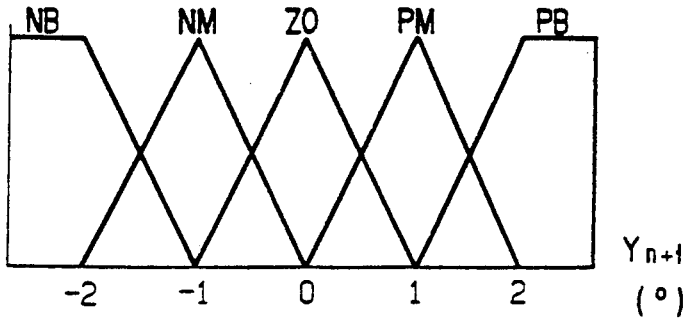

The concrete application of the fuzzy inference for the process of derivation of the rocking operation magnitude is illustrated in FIGS. 7 through 9.

FIG. 7 shows a membership function of the modified pitching angle $\theta$. FIG. 8 shows a membership function of the steering response. FIG. 9 is a membership function of the rocking operation magnitude $Y_{n+1}$ for the next advancing pitch. The table 1 shown below illustrates a fuzzy rule therefor.

The fuzzy rule can be expressed by:

$$\text{IF } \theta_s=\alpha \text{ AND } T=\beta$$

$$\text{THEN } Y_{n+1}=\gamma \quad (1)$$

where $\alpha$, $\beta$ and $\gamma$ represent membership function.

Next, as one example, discussion is given for the arithmetic process for deriving the rocking operation magnitude $Y_{n+1}$ for the next advancing pitch in the case where $\theta_s=-25$ (%) and $T=0.50$ (%/degree).

From the table 1, the controlling rule to be applied are expressed by the following four formulae:

$$\text{IF } \theta_s=NM \text{ AND } T=ML \text{ THEN } Y_{n+1}=PM$$

$$\text{IF } \theta_s=NM \text{ AND } T=LA \text{ THEN } Y_{n+1}=ZO$$

$$\text{IF } \theta_s=ZO \text{ AND } T=ML \text{ THEN } Y_{n+1}=ZO$$

$$\text{IF } \theta_s=ZO \text{ AND } T=LA \text{ THEN } Y_{n+1}=ZO$$

By expressing this by min-max method of the fuzzy inference and deriving the final output by a centroid method, $$Y_{n+1}=0.5 \text{ (degree)}$$

can be derived.

Figure 10A:
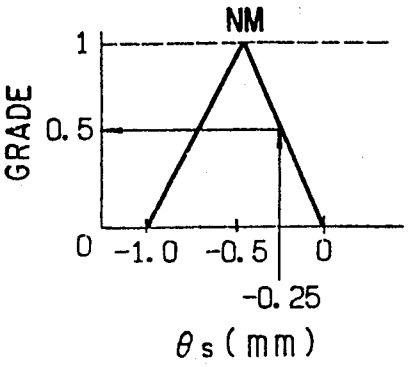
FIGS. 10A through 14 are explanatory illustrations showing an arithmetic process of the rocking magnitude control aiding system portion employing a fuzzy inference.
Figure 10B:
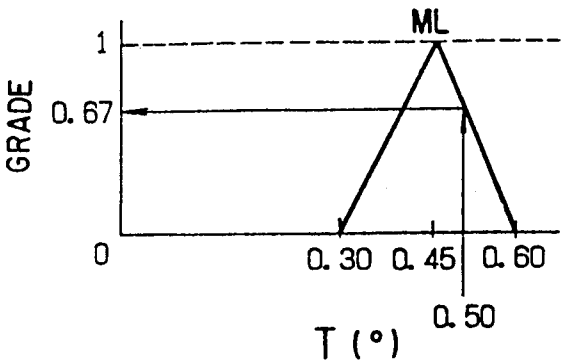
Figure 10C:
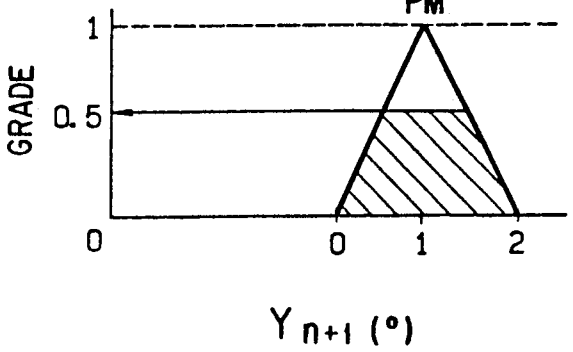

Namely, among the above-identified four formulae, the first formula can be illustrated as shown in FIGS. 10A, 10B and 10C. Then, $\theta_s$ becomes 0.5 and T becomes 0.67. Selecting smaller value (min), $Y_{n+1}$ is derived as 0.5.

Figure 11A:
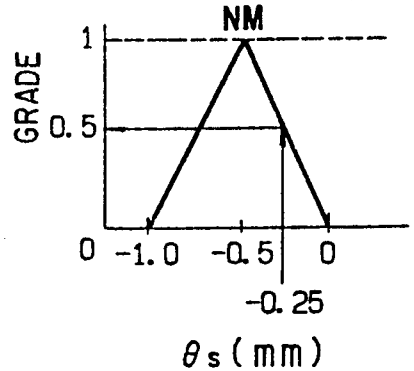
Figure 11B:
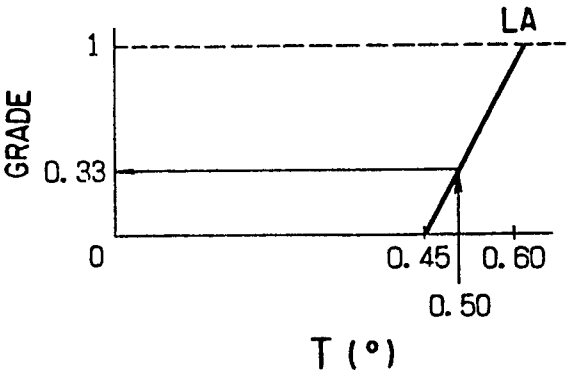
Figure 11C:
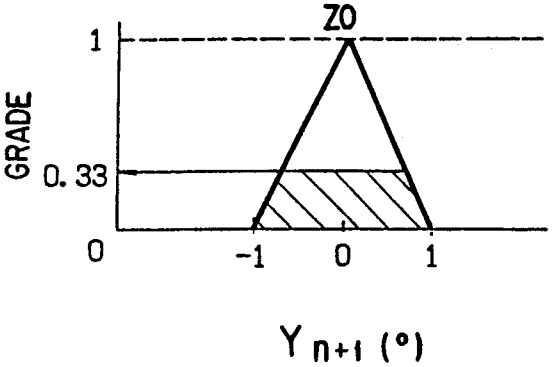

The second formula can be illustrated as shown in FIGS. 11A, 11B and 11C. Then, $\theta_s$ becomes 0.5 and T becomes 0.33. Therefore, $Y_{n+1}$ becomes 0.33.

Figure 12A:
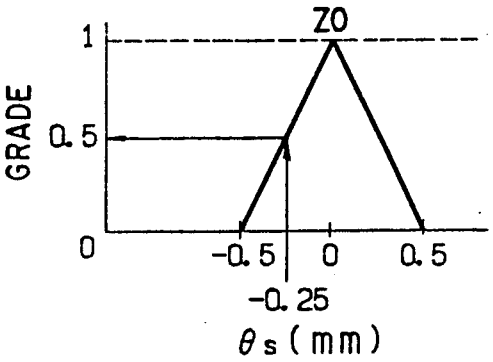
Figure 12B:
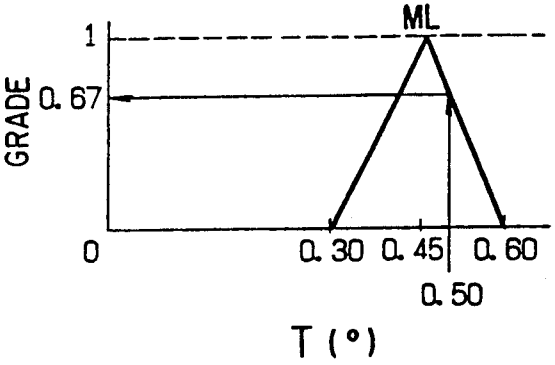
Figure 12C:
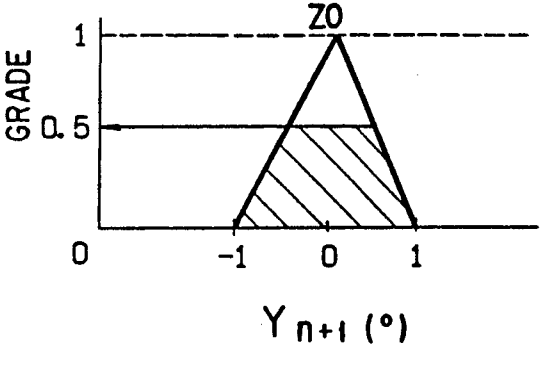

The third formula can be illustrated as shown in FIGS. 12A, 12B and 12C. Then, $\theta_s$ becomes 0.5 and T becomes 0.67. Therefore, $Y_{n+1}$ becomes 0.50.

Figure 13A:
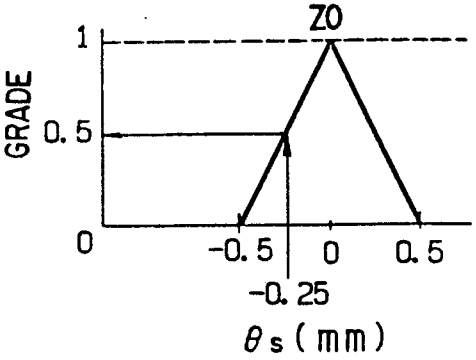
Figure 13B:
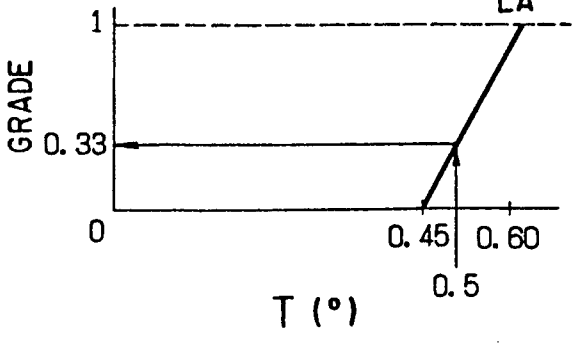
Figure 13C:
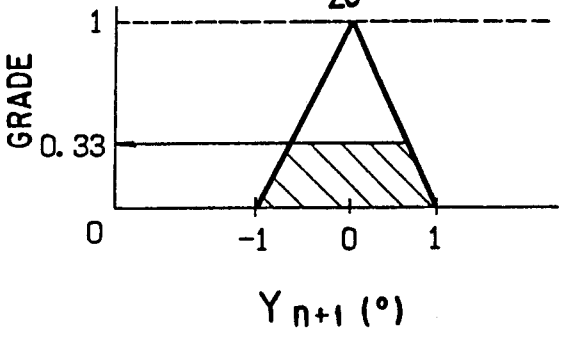
Figure 14:
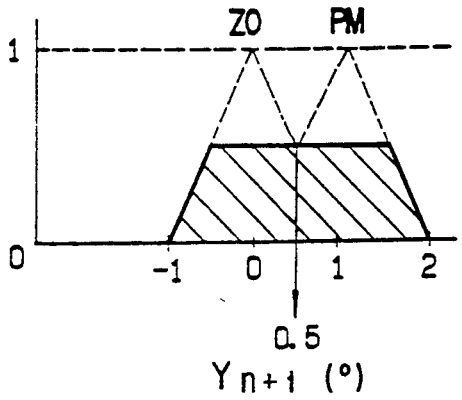

The fourth formula can be illustrated as shown in FIGS. 13A, 13B and 13C. Then, $\theta_s$ becomes 0.5 and T becomes 0.33. Therefore, $Y_{n+1}$ becomes 0.33.

Next, by taking maximum of these four $Y_{n+1}$ and deriving the final output of $Y_{n+1}$ though the centroid method, $$Y_{n+1}=0.5 \text{ (degree)}$$

can be obtained.

On the other hand, in the manner of deriving the steering response T, in addition to the equation:

$$T=\Delta\theta_{pn}/T_n$$

established based only on the rocking operation magnitude and the variation magnitude of the gradient, it is possible to obtain the operation magnitude of the actuator for the next advancing pitch on the basis of the measured values of the sensor through the following equations:

$$T_1=\frac{(\Delta\theta_{pn-2}+\Delta\theta_{pn-1}+\Delta\theta_p)}{(Y_{n-2}+Y_{n-1}+Y_n)} \quad (1)$$

$$T_2=\frac{\Delta\theta_{pn-2}}{Y_{n-2}}+\frac{\Delta\theta_{pn-1}}{Y_{n-1}}+\frac{\Delta\theta_p}{Y_n} \quad (2)$$

In the above-mentioned concrete example, discussion has been given in terms of the vehicle direction control. Similar process may be applicable by substituting the vertical error to the horizontal error and pitching angle to yawing angle.

On the other hand, in FIGS. 3 and 4, the pilot head 1 is illustrated as an excavation type, the invention may be applicable for a compression type pilot head as far as it is provided with the similar actuator and sensor.

TABLE 1

| | | T | | | | |
|---|---|---|---|---|---|---|
| $Y_{n+1}$ | | SA | SM | MM | ML | LA |
| $\Theta_s$ | NB | PB | PB | PB | PM | PM |
| | NM | PB | PM | PM | PM | ZO |
| | ZO | ZO | ZO | ZO | ZO | ZO |
| | PM | NB | NM | NM | NM | ZO |
| | PB | NB | NB | NB | NM | NM |

Figure 15:
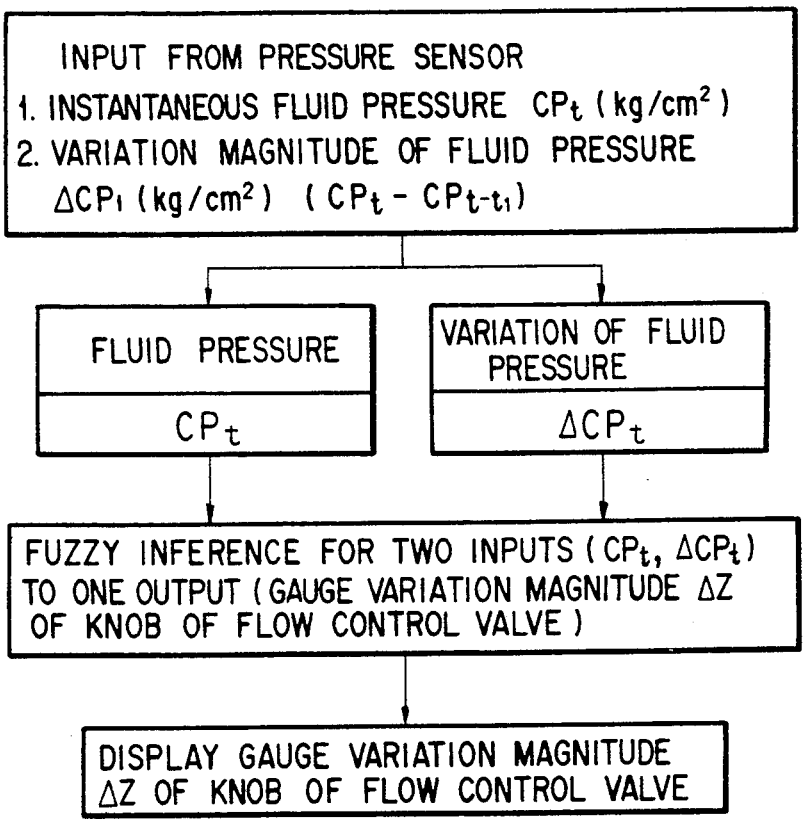
FIG. 15 is a flowchart showing operation of a cutter torque control aiding system portion.

Next, the operation of the cutter torque control aiding system portion 16b will be discussed with reference to the flowchart illustrated in FIG. 15 and the block diagram illustrated in FIG. 1.

An instantaneous fluid pressure $CP_t$ (kg/cm$^2$) and the variation amount $\Delta CP_t$ (kg/cm$^2$) are detected by the cutter torque pressure sensor 12b of the sensor group 12. It should be noted that $\Delta CP_t=CP_t-CP_{t-t1}$. These are input to the second measurement section 14b of the automatic measurement portion 14 of the controller 13.

Then, the measured values are input to the second adjustment section 15b of the automatic adjustment portion 15. Tow input values $CP_t$ and $\Delta CP_t$ are then input therefrom to the cutter torque control aiding system section 16b of the fuzzy control portion 16. Thus, one output value incorporating the manner of operation of the skilled operator is output through the fuzzy inference. This output value serves as the variation magnitude $\Delta Z$ of a gauge on a knob of a flow control valve for controlling the hydraulic motor.

Then, the gauge variation magnitude $\Delta Z$ is displayed on the CRT 17a of the display output device 17.

The operator operates the gauge of the adjusting knob of the flow control valve according to the gauge variation magnitude $\Delta Z$ displayed on the CRT 17a, for example over $0\sim10$.

Figure 16:
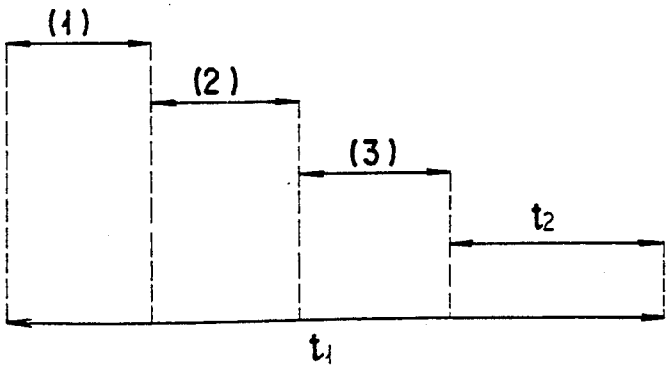
FIG. 16 is a timing chart showing operation of the cutter torque control aiding system portion.

The display on the display output device 17 is done in real time basis. However, it should take a certain period from detection of the signals from the sensors to displaying the corresponding result. This is illustrated in FIG. 16, in which (1) shows a period required for transmission of the sensor signals to the second adjustment portion 15*b* of the automatic adjustment portion 15 of the controller 13, (2) shows a calculation period employing the fuzzy inference in the cutter torque control aiding system portion 16*b*, and (3) is a period required for transmitting a result of inference to the display output device. On the other hand, $t_1$ is a period derived by adding $t_2$ for a sum of the above-mentioned periods (1), (2) and (3).

Figure 17:
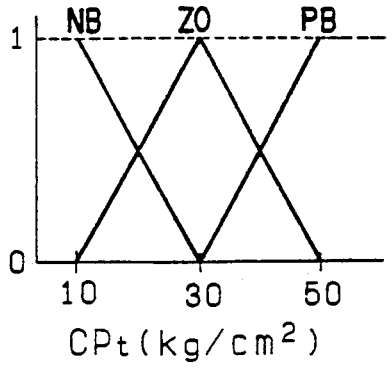
FIGS. 17, 18 and 19 are charts showing membership functions in the cutter torque control aiding system.
Figure 18:
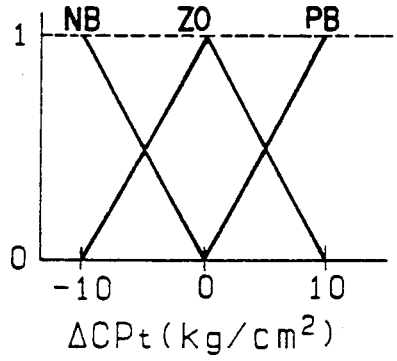
Figure 19:
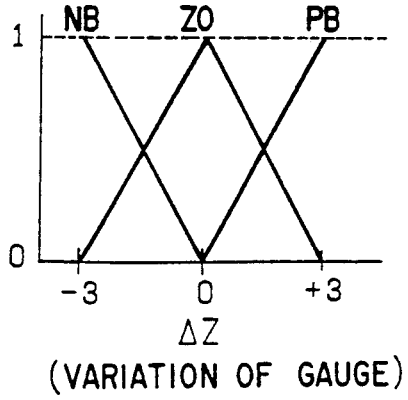

FIGS. 17 to 19 illustrate a manner of concrete application of the fuzzy inference in derivation of the gauge variation magnitude $\Delta Z$ of the adjusting knob of the flow control valve.

FIG. 17 shows a membership function of the fluid pressure $CP_t$. FIG. 18 shows a membership function of the fluid pressure variation magnitude $\Delta CP_t$. FIG. 19 shows a membership function of the gauge variation magnitude $\Delta Z$ of the adjusting knob of the flow control valve. Furthermore, a table 2 shown below represents the fuzzy control rule therefor.

The fuzzy rule can be expressed by:

$$\text{IF } CP_t=\alpha \text{ AND } \Delta CP_t=\beta$$

$$\text{THEN } 66\ Z=\gamma \qquad (2)$$

where $\alpha$, $\beta$ and $\gamma$ represent membership function.

Next, as one example, discussion is given for the arithmetic process for deriving the gauge variation amount $\Delta Z$ of the adjusting knob of the flow control valve for the next advancing pitch in the case where $CP_t=20$ kg/cm$^2$ and $\Delta CP_t=7.5$ kg/cm$^2$.

From the table 2, the controlling rule to be applied are expressed by the following four formulae:

$$\text{IF } CP_t=\text{NB AND } CP_t=\text{ZO THEN } Z=\text{PB}$$

$$\text{IF } CP_t=\text{NB AND } CP_t=\text{PB THEN } Z=\text{ZO}$$

$$\text{IF } CP_t=\text{ZO AND } CP_t=\text{ZO THEN } Z=\text{ZO}$$

$$\text{IF } CP_t=\text{ZO AND } CP_t=\text{PB THEN } Z=\text{ZO}$$

By expressing this by min-max method of the fuzzy inference and deriving the final output by a centroid method, $$\Delta Z=0.94 \text{ (increasing of gauge)}$$

can be derived.

Figure 20A:
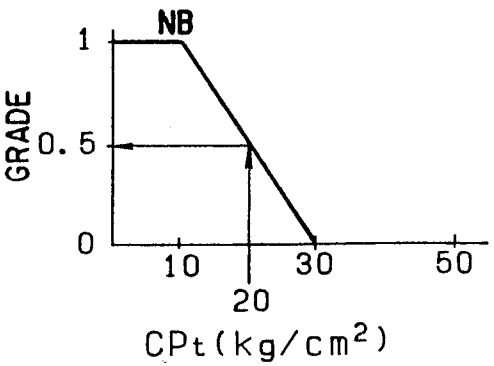
FIGS. 20A through 24 are explanatory illustrations showing an arithmetic process of the cutter torque control aiding system portion employing a fuzzy inference.
Figure 20B:
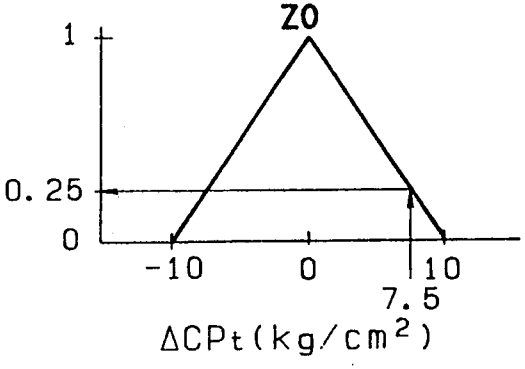
Figure 20C:
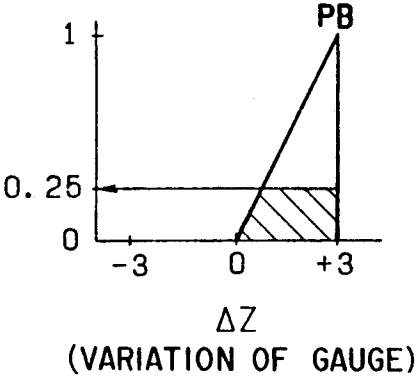

Namely, among the above-identified four formulae, the first formula can be illustrated as shown in FIGS. 20A, 20B and 20C. Then, $CP_t$ becomes 0.5 and $\Delta CP_t$ becomes 0.25. Selecting smaller value (min), $\Delta Z$ is derived as 0.25.

Figure 21A:
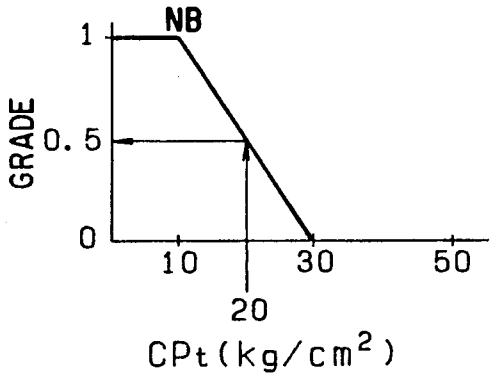
Figure 21B:
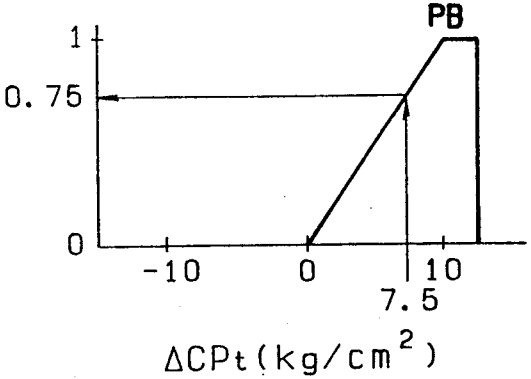
Figure 21C:
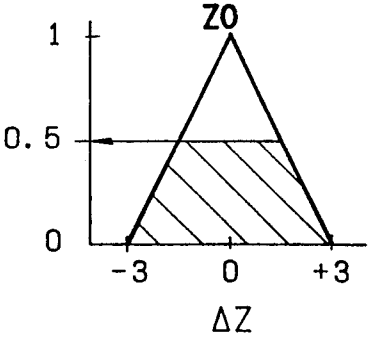

The second formula can be illustrated as shown in FIGS. 21A, 21B and 21C. Then, $CP_t$ becomes 0.75 and $\Delta CP_t$ becomes 0.5. Therefore, $\Delta Z$ becomes 0.5.

Figure 22A:
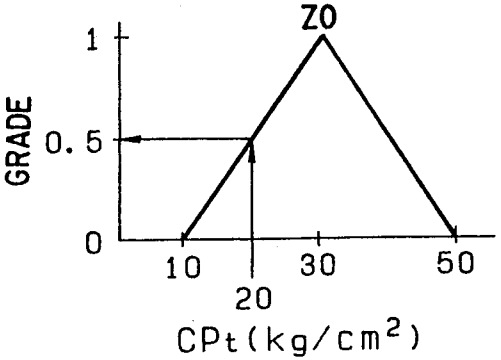
Figure 22B:
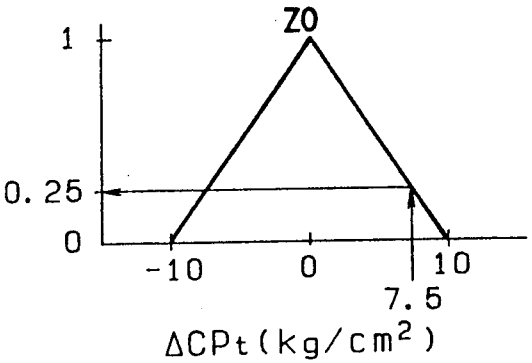
Figure 22C:
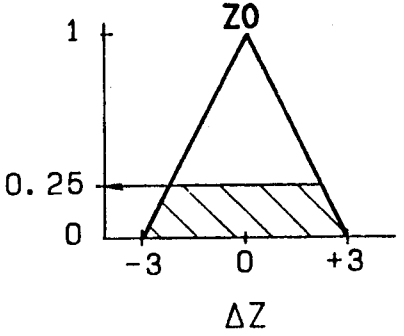

The third formula can be illustrated as shown in FIGS. 22A, 22B and 22C. Then, $CP_t$ becomes 0.5 and $\Delta CP_t$ becomes 0.75. Therefore, $\Delta Z$ becomes 0.5.

Figure 23A:
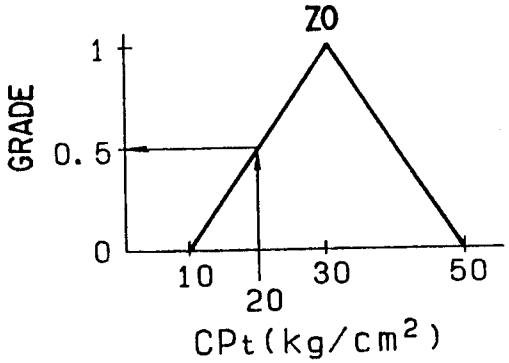
Figure 23B:
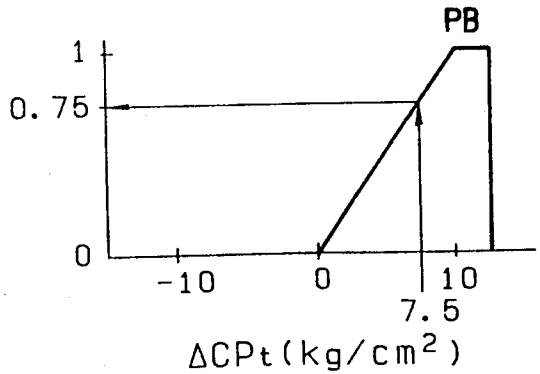
Figure 23C:
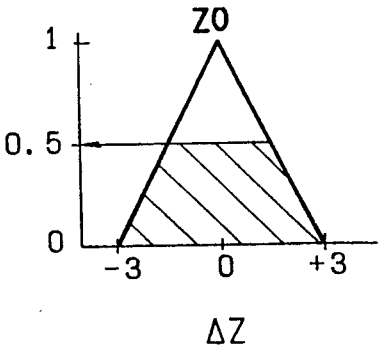
Figure 24:
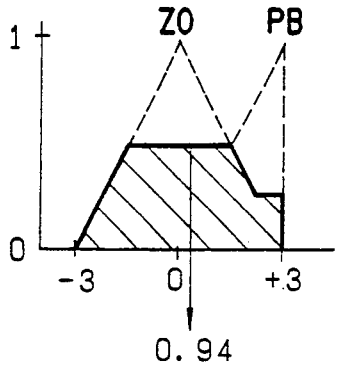

The fourth formula can be illustrated as shown in FIGS. 23A, 23B and 23C. Then, $CP_t$ becomes 0.5 and $\Delta CP_t$ becomes 0.75. Therefore, $\Delta AZ$ becomes 0.5.

Next, by taking maximum of these four $\Delta Z$ and deriving the final output of $\Delta Z$ though the centroid method, $$\Delta Z=0.94 \text{ (increasing of gauge)}$$

can be obtained.

TABLE 2

| | | ΔCP | | |
|---|---|---|---|---|
| ΔZ | | NB | ZO | PB |
| CP | NB | PB | PB | ZO |
| | ZO | ZO | ZO | ZO |
| | PB | ZO | NB | NB |

As set forth above, since the rocking magnitude derived by the rocking magnitude control aiding system section 16*a* and the cutter torque control operating information (adjusting magnitude of the adjusting knob of the flow control valve) are displayed on the CRT 17*a* of the display output device 17, in the system for aiding operation, the operator may perform operation comparable to the skilled operator according to the display content.

Figure 25:
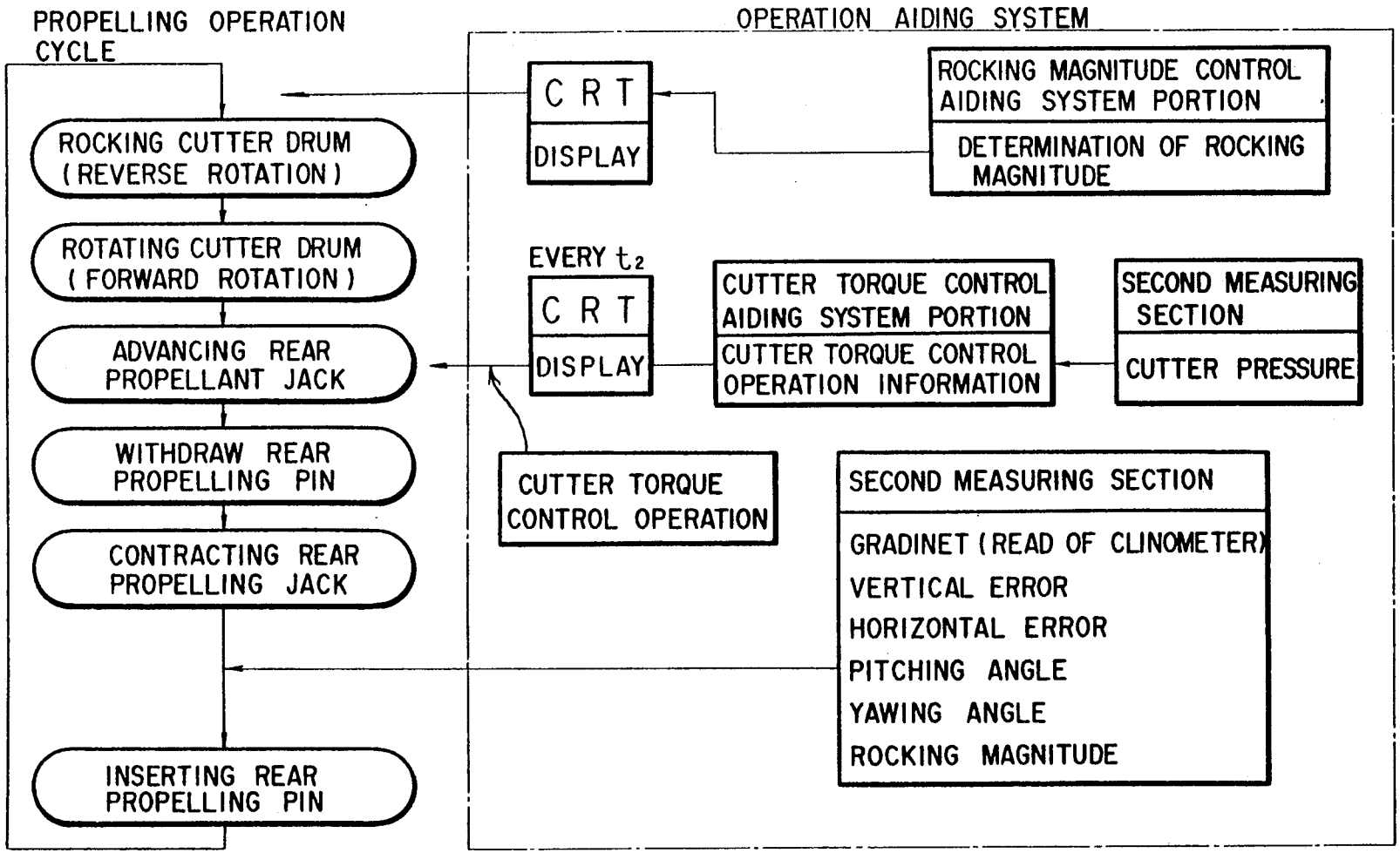
FIG. 25 is an illustration showing a propelling operation cycle by an operation system.
Figure 26:
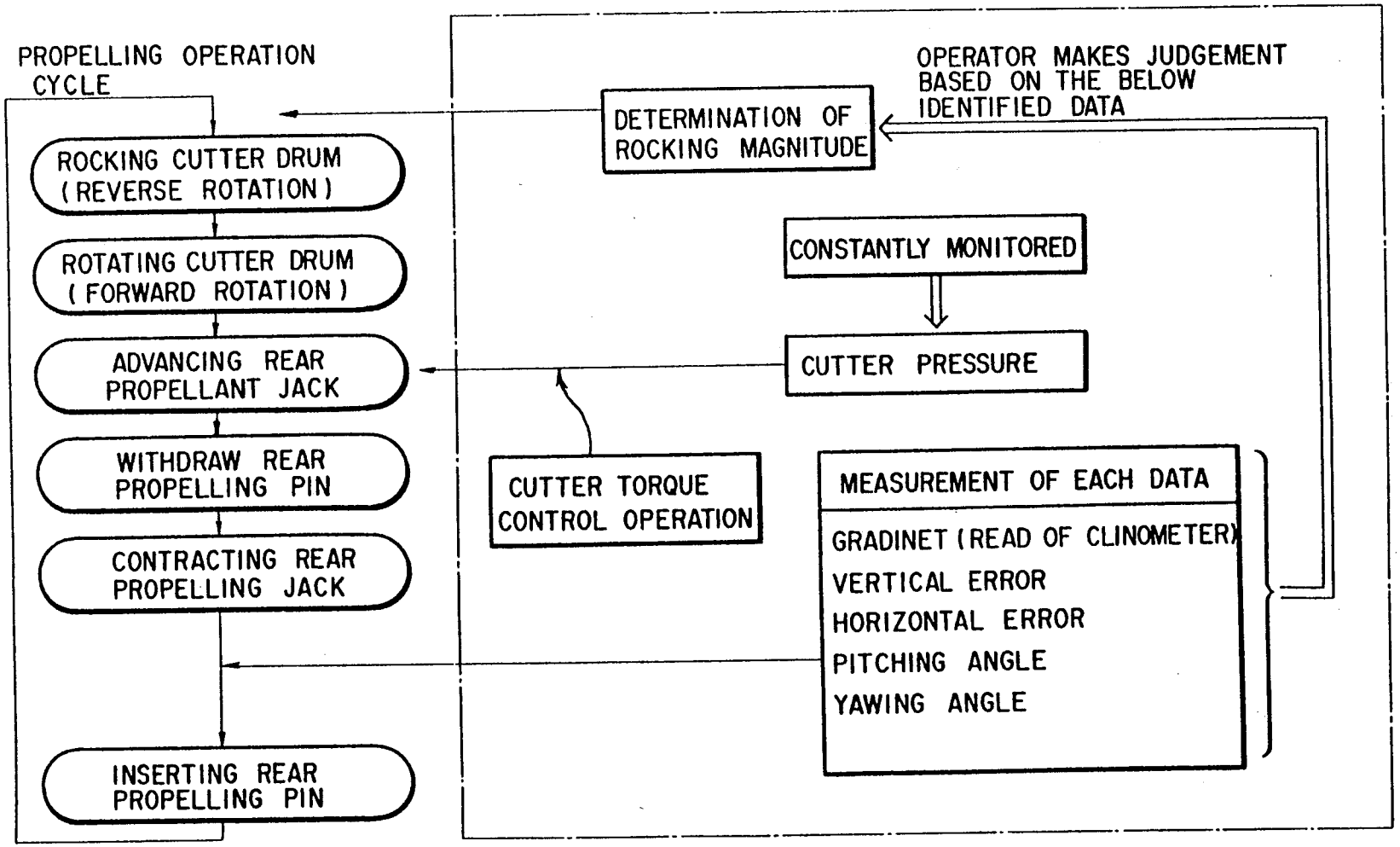
FIG. 26 PRIOR ART
FIG. 26 is an illustration showing the propelling operation cycle in the prior art.

FIG. 25 illustrates an operation cycle of the system for aiding operation. The output of the rocking magnitude control aiding system section 16*a* is displayed upon rocking operation of the cutter drum. As well, the output of the cutter torque control aiding system section 16*b* is also displayed upon propelling of the rear propellant jack (upon cutter torque control operation). It should be noted that these display may be switched every 20 seconds.

On the other hand, reading out of the detected value to the first measurement section 14*a* of the automatic measurement portion 14 is performed after the rear propellant jack contraction step.

While the shown embodiment simply displays the rocking magnitude data and/or the cutter torque pressure adjustment data (adjustment magnitude of the adjusting knob of the flow control valve) so that the operator may perform manual adjustment according thereto, it should be obvious to those skilled in the art to apply the rocking magnitude data and/or the cutter torque pressure adjustment data to appropriate actuators for automatically performing adjustment.

What is claimed is:

1. A system for aiding operation of an excavating type underground advancing machine comprising:

a rocking actuator for controlling orientation;

an excavation cutter provided at the front face of a cutter drum positioned at the tip end;

a first sensor group for monitoring a position error magnitude and angular deflection magnitude relative to a construction planning line, and an operation magnitude of said rocking actuator;

a second sensor for monitoring a fluid pressure for a cutter torque;

wherein the system further comprising:

an automatic measurement portion for obtaining output signals of said sensors group and said cutter torque pressure sensor;

an automatic adjustment portion for adjusting said signals as input values for fuzzy inference;

a rocking magnitude control aiding portion for outputting an optimal rocking magnitude of said orientation controlling actuator for the next advancing pitch based on the adjusted input values of said first sensor group through fuzzy inference;

a cutter torque control aiding portion for outputting a control information for the excavating cutter torque based on the adjusted input value from said second sensor for cutter torque pressure control through the fuzzy inference; and a display output device for displaying the outputs of said both system portions.

2. A system for aiding operation of an excavating type advancing machine having a cutter drum;

an actuator for rocking said cutter drum for controlling advancing direction;

a motor for rotatingly driving said cutter drum;

a first sensor group for monitoring a position error of the tip end of said cutter drum and a deflection of gradient thereof relative to a construction planning line, and an operation magnitude of said actuator; and a second sensor for monitoring a cutter torque; the operation aiding system comprising:

an automatic measurement portion for receiving signals from said first sensor group and said second sensor;

an automatic adjustment portion for adjusting signals from said automatic measurement portion as input values for fuzzy inference;

an operation magnitude control aiding system portion for outputting an optimal operation magnitude of said actuator for the next advancing pitch on the basis of said adjusted input values from said first sensor group through the fuzzy inferences;

a cutter torque control aiding system portion for outputting an optimal operation magnitude of said motor for the next advancing pitch on the basis of said adjusted input value from said second sensor through the fuzzy inference; and a display output device for displaying outputs of both of said system portions.

3. A propulsion control system for an excavation type underground propulsive advancing apparatus comprising:

an elongated cutter means for propelling in the underground;

a driving means for rotatingly driving said cutter means for excavating propulsion through the underground, said driving means being variable of a driving torque;

an attitude control means for controlling attitude of said cutter means said attitude control means being operable for adjusting attitude of said cutter means at a controlled magnitude;

a monitoring means associated with said cutter means for monitoring attitude and excavating behavior of said cutter means for producing an operation parameter indicative signal; and a control means processing said operation parameter indicative signal for establishing an attitude control parameter based on the operation parameter indicative signal, a desired attitude and a predetermined first certainty rule, and a torque control parameter based on the operation parameter indicative signal and a predetermined second certainty rule for deriving an optimum driving torque and an optimum adjusting magnitude of attitude control on the basis of said torque control parameter and said attitude control parameter.

4. A propulsion control system for an excavation type underground propulsive advancing apparatus comprising:

an elongated cutter means for propelling in the underground;

a propelling means cyclically operable through each advancing cycle for intermittently propelling said cutting means through the underground a driving means for rotatingly driving said cutter means for excavating propulsion through the underground, said driving means being variable of a driving torque;

an attitude control means for controlling attitude of said cutter means said attitude control means being operable for adjusting attitude of said cutter means at a controlled magnitude;

a monitoring means associated with said cutter means for monitoring attitude and excavating behavior of said cutter means for producing a first operation parameter indicative signal representative of a deviation of the attitude of the cutter means relative to a desired attitude and a second operation parameter indicative signal representative of an adjustment magnitude of attitude in the current advancing cycle, and third operation parameter indicative signal representative of the driving torque of said driving means in the current advancing cycle; and a control means processing said operation parameter indicative signal for establishing an attitude control parameter based on the first and second operation parameter indicative signals and a predetermined first certainty rule, and a torque control parameter based on the third operation parameter indicative signal and a predetermined second certainty rule for deriving an optimum driving torque and an optimum adjusting magnitude of attitude control on the basis of said torque control parameter and said attitude control parameter.

5. A propulsion control system for an excavation type underground propulsive advancing apparatus comprising:

an elongated cutter means for propelling in the underground;

a propelling means cyclically operable through each advancing cycle for intermittently propelling said cutting means through the underground;

a driving means for rotatingly driving said cutter means for excavating propulsion through the underground, said driving means being variable of a driving torque;

an attitude control means for controlling attitude of said cutter means said attitude control means being operable for adjusting attitude of said cutter means at a controlled magnitude;

a monitoring means associated with said cutter means for monitoring attitude and excavating behavior of said cutter means for producing a first operation parameter indicative signal representative of a deviation of the attitude of the cutter means relative to a desired attitude and a second operation parameter indicative signal representative of an adjustment magnitude of attitude in the current advancing cycle, and a third operation parameter indicative signal representative of the driving torque of said driving means in the current advancing cycle; and a control means processing said operation parameter indicative signal for establishing an attitude control parameter based on the first and second operation parameter indicative signals and according to a predetermined first rule for fuzzy inference, and a torque control parameter based on the third operation parameter indicative signal and according to a predetermined second rule for fuzzy inference, and deriving an optimum driving torque and an optimum adjusting magnitude of attitude control on the basis of said torque control parameter and said attitude control parameter.

6. A propulsion control system for an excavation type underground propulsive advancing apparatus comprising:

an elongated cutter means for propelling in the underground;

a driving means for rotatingly driving said cutter means for excavating propulsion through the underground, said driving means being variable of a driving torque;

an attitude control means for controlling attitude of said cutter means said attitude control means being operable for adjusting attitude of said cutter means at a controlled magnitude;

a monitoring means associated with said cutter means for monitoring attitude and excavating behavior of said cutter means for producing an operation parameter indicative signal;

a control means processing said operation parameter indicative signal for establishing an attitude control parameter based on the operation parameter indicative signal, a desired attitude and a predetermined first certainty rule, and a torque control parameter based on the operation parameter indicative signal and a predetermined second certainty rule for deriving an optimum driving torque and an optimum adjusting magnitude of attitude control on the basis of said torque control parameter and said attitude control parameter; and a display means for displaying said optimum driving torque and/or said optimum adjusting magnitude.

7. A propulsion control system for an excavation type underground propulsive advancing apparatus comprising:

an elongated cutter means for propelling in the underground;

a propelling means cyclically operable through each advancing cycle for intermittently propelling said cutting means through the underground;

a driving means for rotatingly driving said cutter means for excavating propulsion through the underground, said driving means being variable of a driving torque;

an attitude control means for controlling attitude of said cutter means said attitude control means being operable for adjusting attitude of said cutter means at a controlled magnitude;

a monitoring means associated with said cutter means for monitoring attitude and excavating behavior of said cutter means for producing a first operation parameter indicative signal representative of a deviation of the attitude of the cutter means relative to a desired attitude and a second operation parameter indicative signal representative of an adjustment magnitude of attitude in the current advancing cycle, and a third operation parameter indicative signal representative of the driving torque of said driving means in the current advancing cycle;

a control means processing said operation parameter indicative signal for establishing an attitude control parameter based on the first and second operation parameter indicative signals and a predetermined first certainty rule, and torque control parameter based on the third operation parameter indicative signal and a predetermined second certainty rule for deriving an optimum driving torque and an optimum adjusting magnitude of attitude control on the basis of said torque control parameter and said attitude control parameter; and a display means for displaying said optimum driving torque and/or said optimum adjusting magnitude.

8. A propulsion control system for an excavation type underground propulsive advancing apparatus comprising:

an elongated cutter means for propelling in the underground;

a propelling means cyclically operable through each advancing cycle for intermittently propelling said cutting means through the underground;

a driving means for rotatingly driving said cutter means for excavating propulsion through the underground, said driving means being variable of a driving torque;

an attitude control means for controlling attitude of said cutter means said attitude control means being operable for adjusting attitude of said cutter means at controlled magnitude;

a monitoring means associated with said cutter means for monitoring attitude and excavating behavior of said cutter means for producing a first operation parameter indicative signal representative of a deviation of the attitude of the cutter means relative to a desired attitude and a second operation parameter indicative signal representative of an adjustment magnitude of attitude in the current advancing cycle, and a third operation parameter indicative signal representative of the driving torque of said driving means in the current advancing cycle;

a control means processing said operation parameter indicative signal for establishing an attitude control parameter based on the first and second operation parameter indicative signals and according to a predetermined first rule for fuzzy inference, and a torque control parameter based on the third operation parameter indicative signal and according to a predetermined second rule for fuzzy inference, and deriving an optimum driving torque and an optimum adjusting magnitude of attitude control for the next advancing cycle on the basis of said torque control parameter and said attitude control parameter; and a display means for displaying said optimum driving torque and/or said optimum adjusting magnitude.

* * * * *